US005899766A

United States Patent [19]

DeFeo

[11] Patent Number: 5,899,766

[45] Date of Patent: May 4, 1999

[54] ELECTRICAL CONNECTOR SYSTEM

[75] Inventor: Stephen V. DeFeo, Alpharetta, Ga.

[73] Assignee: W.W. Fisher, S.A., Switzerland

[21] Appl. No.: 08/935,439

[22] Filed: Sep. 23, 1997

[51] Int. Cl.[6] ..... H01R 27/00

[52] U.S. Cl. ..... 439/218; 439/680

[58] Field of Search ..... 439/218, 680, 439/221, 222

[56] References Cited

U.S. PATENT DOCUMENTS

| | | | |
|---|---|---|---|
| 3,160,457 | 12/1964 | Fischer | 439/352 |
| 4,109,989 | 8/1978 | Snyder et al. | 439/140 |
| 4,245,875 | 1/1981 | Shaffer et al. | 439/680 |
| 5,302,141 | 4/1994 | O'Reilly et al. | 439/680 |

*Primary Examiner*—Steven L. Stephan
*Assistant Examiner*—T. C. Patel
*Attorney, Agent, or Firm*—Jones & Askew, LLP

[57] ABSTRACT

An electrical connection configuration which can be used to upgrade an electrically-connected two part system to allow for a "first" component of the original system to interact with either a "second" component of the original system or an alternate "second" component being part of an alternate system, while restricting connection between the "first" component of the alternate system to connection only with the "second" component of the alternate system. Connection is prevented between the "first" component (e.g., a hand tool) of the alternate system and the "second" component (e.g., a control box) of the original system.

10 Claims, 5 Drawing Sheets

ISOLATED FEMALE CONNECTOR ASSEMBLY W/THREADED NUT

ELECTRICAL CONNECTOR SYSTEM

TECHNICAL FIELD

This invention relates in general to electrical connectors, and particularly relates to an electrical connection system which, as an example, allows one type of plug to fit within either of two receptacles, but allows another plug to fit only within one of the same two receptacles.

BACKGROUND OF THE INVENTION

Electrical connectors have long been known in the art. For example, U.S. Pat. No. 3,160,457, to Walter Fischer, patented Dec. 8, 1964, entitled "Electrical Connecting Device", issued on an application filed in the United States on Nov. 30, 1962 is a good example of such connectors. The Fischer '457 Patent, incorporated herein by reference, discloses a detachable parallel electric current path connecting device, which is formed of two parts, each adapted to be connected to a respective electrical conductor, one of these parts carrying at least one male contact and the other carrying at least one corresponding female contact. This configuration has served the industry well through the years as a reliable, effective connector.

Although the above configuration includes advantages, there is always room for improvement, including improvements in how such connectors are used in various applications. For example, as upgrades are made to electrical equipment including such connectors, for safety and/or regulatory reasons it may be necessary that certain cross-system connections between system versions be prevented while other cross-system connections are allowed.

As an example, one may assume a typical system scenario in which a hand tool is attached to a control box though an electrical cord having a detachable connection therein. An upgrade is then made by the system manufacturer to both the hand tool and the control box. This results in the existence in the field of original hand tools configured to connect with original control boxes, as well as upgraded hand tools configured to connect with upgraded control boxes. If there is no desire to allow any interaction between the two systems, prior art connecting schemes can be used to provide different mating connections similar in concept to the different wall plug configurations used between 110 and 220 Volt AC systems. In other words, an original plug only fits an original receptacle, and an upgraded plug only fits an upgraded receptacle. There is no "cross-system connectivity".

However, there may be a desire by the system manufacturers to allow, as an example, the original hand tools to connect with the upgraded control boxes, but to prevent the upgraded hand tools to connect with the original control boxes. This need cannot be met by the known prior art.

Therefore, there is a need in the art for an electrical connection configuration which can be used to upgrade an electrically-connected two part system to allow for a "first" component of the original system to interact with either a "second" component of the original system or an alternate (i.e. upgraded) "second" component being part of an alternate system, while restricting connection between the "first" component of the alternate system to connection only with the "second" component of the alternate system, and while preventing connections between the "first" component (e.g., a hand tool) of the alternate system and the "second" component (e.g., a control box) of the original system.

SUMMARY OF THE INVENTION

The present invention overcomes inadequacies in the prior art by providing an electrical connection configuration which can be used to upgrade an electrically-connected two part system to allow for a "first" component of the original system to interact with either a "second" component of the original system or an alternate "second" component being part of an alternate system, while restricting connection between the "first" component of the alternate system to connection only with the "second" component of the alternate system, and preventing connection between the "first" component (e.g., a hand tool) of the alternate system and the "second" component (e.g., a control box) of the original system.

Therefore it is an object of the present invention to provide an improved electrical connection system.

Therefore it is an object of the present invention to provide an improved electrical connector group.

It is a further object of the present invention to provide an electrical connection system which is simple to manufacture.

It is a further object of the present invention to provide an electrical connection system which is simple to use.

It is a further object of the present invention to provide an electrical connection system which is reliable in operation.

It is a further object of the present invention to provide an electrical connection system which is safe in operation.

Other objects, features, and advantages of the present invention will become apparent upon reading the following detailed description of the preferred embodiment of the invention when taken in conjunction with the drawing and the appended claims.

DETAILED DESCRIPTION OF THE PREFERRED EMBODIMENT

Reference is now made to the drawings, in which like numerals represent like elements throughout the several views.

General Construction and Operation

Figure 1:
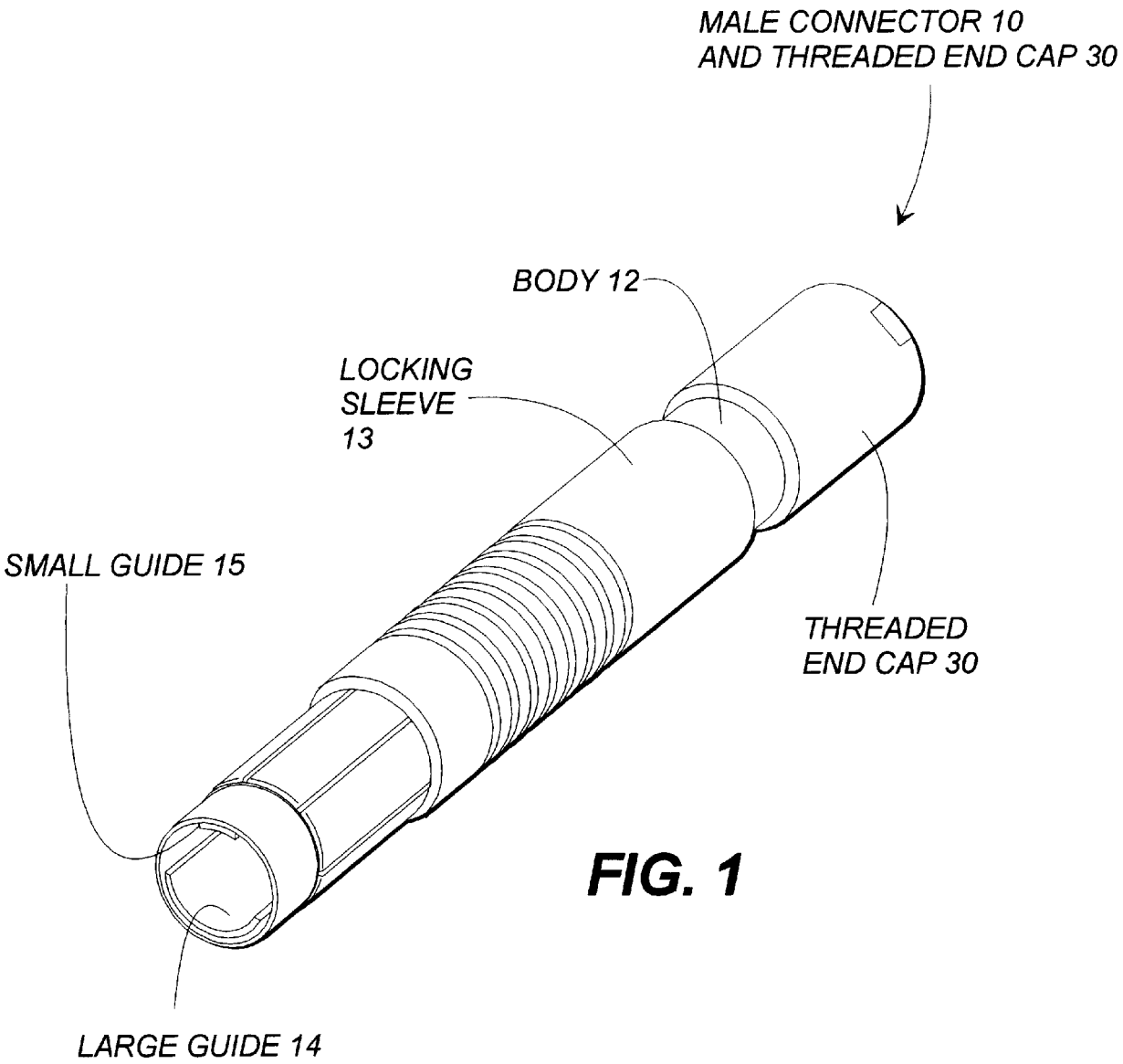
FIG. 1 is a pictorial view of a "male"-type connector 10 having a threaded end cap 30 attached thereto. The male electrical connector is shown with a large guide 14 and a small guide 15.
Figure 2:
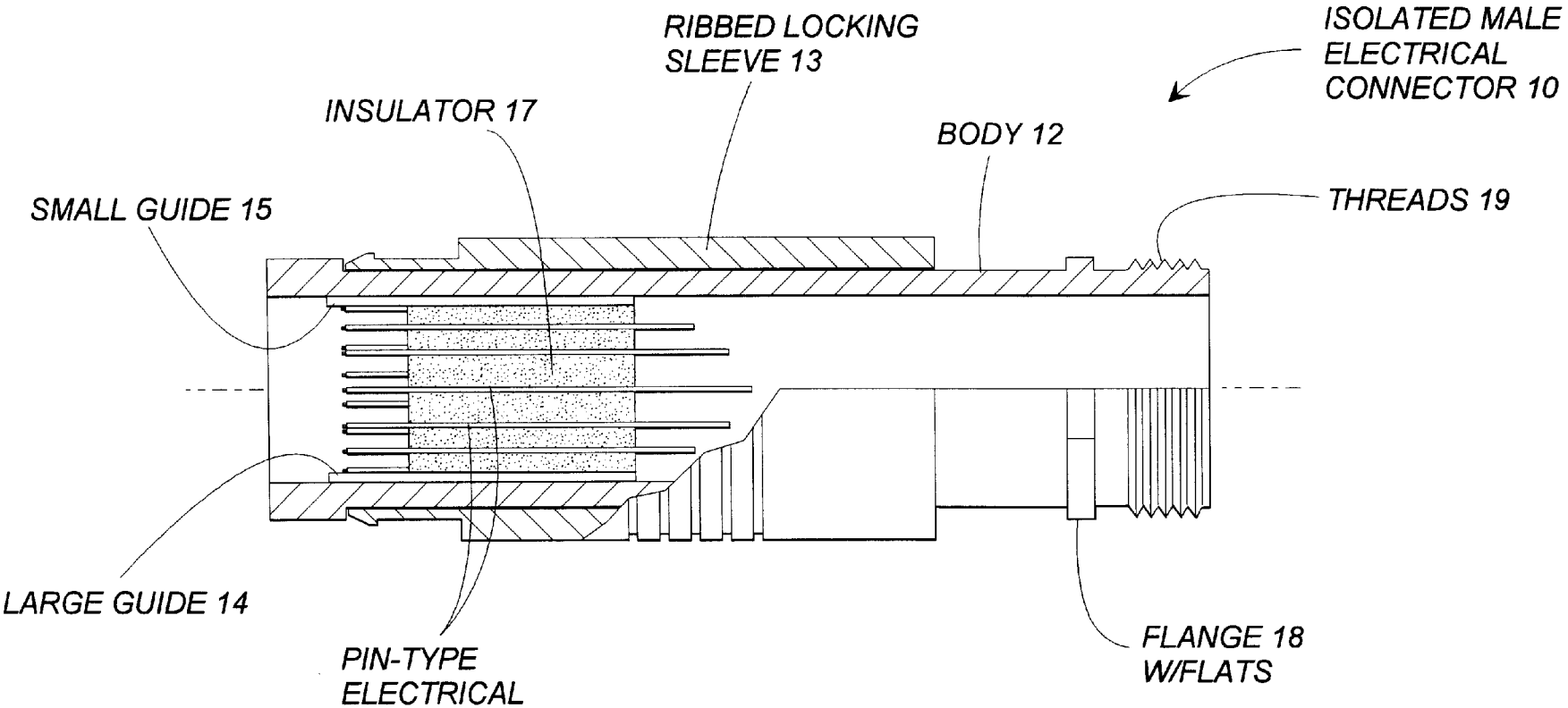
FIG. 2 is an isolated partially cut-away side elevational view of a male electrical connector assembly 10 or "plug", which shows a body 12, a ribbed locking sleeve 13 similar to those known in the art, a large guide 14, a small guide 15, an insulator 17, and pin-type solid electrical contacts 16 such as known in the art.
Figure 3:
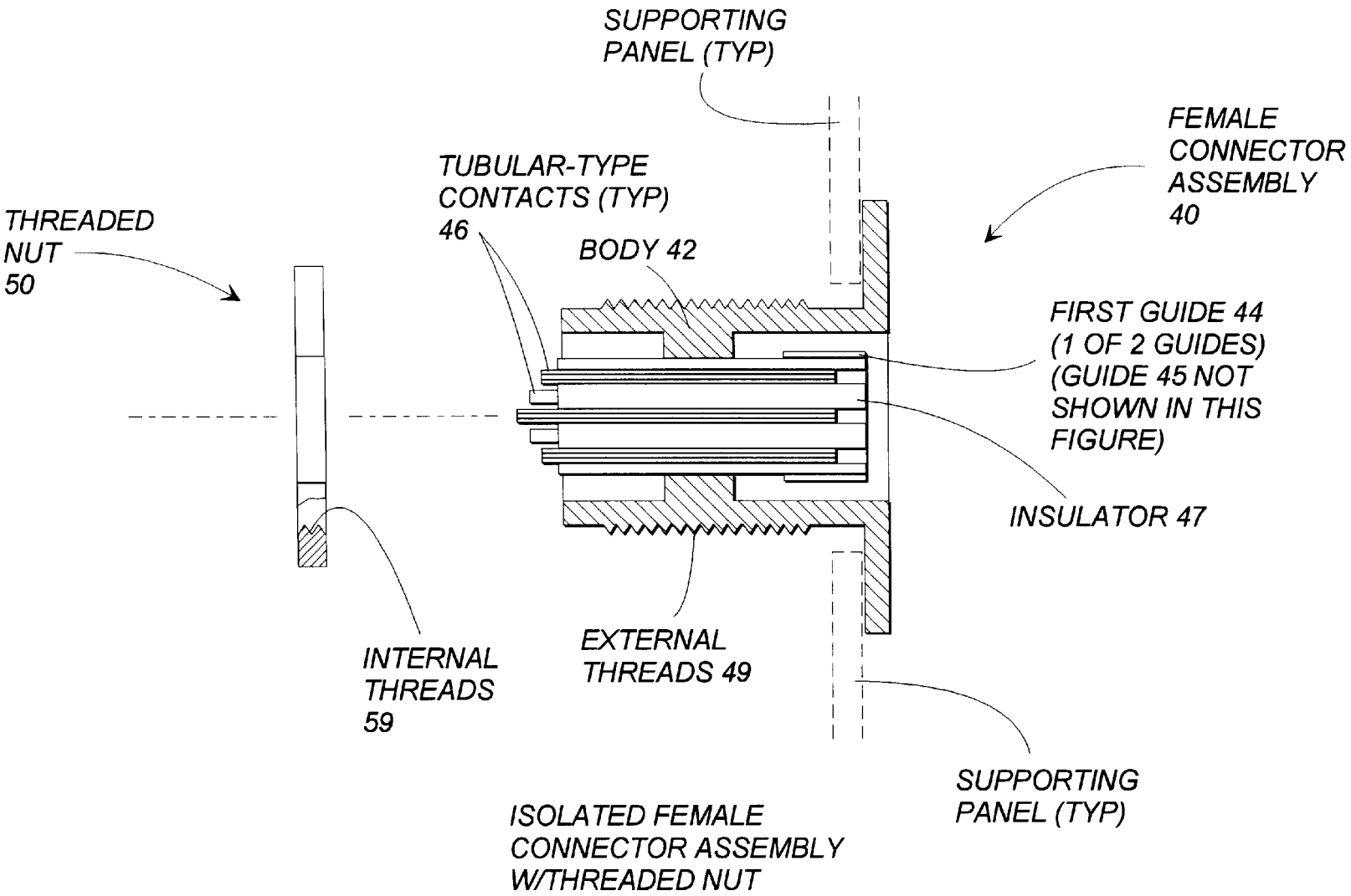
FIG. 3 is a side elevational view of a "female"-type electrical connector assembly 40 or "receptacle", which shows a body 42, an insulator 47, sleeve-type tubular electrical contacts 46 such as known in the art, and first and second guides 44, 45, respectively. The assembly 40 is shown in FIG. 3 alongside a threaded nut 50 having internal threads 59 which engage external threads 49 on the body 42 of the connector assembly 40.

Generally described, an electrical connector such as that shown as 10 in FIGS. 1 and 2 engages an electrical connector such as that shown as 40 in FIG. 3, to provide multiple independent electrical connections therethrough. When use in conjunction with previously-existing connectors such as 110 and 140 shown in FIG. 6, such connectors allow for the "old" (a.k.a "existing" or "original") male and female connectors 110, 140, respectively, to mate together to provide multiple independent electrical connections therethrough, the "new" (a.k.a "alternate" or "upgraded") male and female connectors 10, 40, to provide multiple independent electrical connections therethrough, and the "new" female connector 40 to accept both the connectors 110, 10, respectively. However, the female connector 140 will only accept the connector 110 and not the certain connector 10. This has been found necessary to address safety regulation requirements, but is not limited to such applications.

The Male Connector

FIG. 1 is a pictorial view of a male connector assembly 10 having a threaded end cap 30 attached thereto. The male electrical connector 10 is shown with a large guide 14 and a small guide 15. As discussed later, such guides can either provide alignment during engagement of the connectors or can interfere, preventing engagement. In this embodiment, the guides 14, 15 are part of an integral guide member which includes a ring-like base having both of the guides extending in one common direction in a flangelike manner.

FIG. 2 is an isolated partially cut-away side elevational view of a male electrical connector assembly 10 or "plug", which includes a body 12, a ribbed locking sleeve 13 similar to those known in the art, a large guide 14, a small guide 15, a molded insulator 17, and pin-type solid electrical contacts 16 such as known in the art.

As FIG. 2 is viewed, the left ends of the electrical contacts engage and provide the detachable electrical connections, The ends on the right accept solder or other types of more permanent electrical connections.

The locking sleeve 13 is ribbed for ease of grasping although other configurations are contemplated without departing from the spirit and scope of the present invention. When the sleeve is pulled back, it falls into a recess underneath, and allows the shoulder to clear. The recess is not shown in the drawings.

Figure 6:
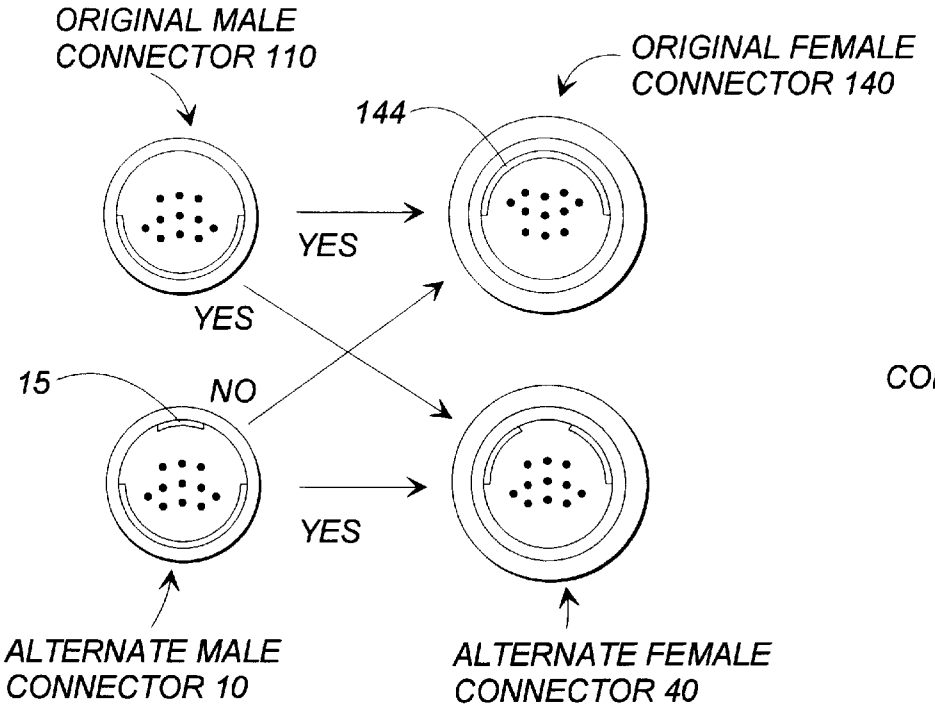
FIG. 6 shows the essence of the invention, in which "original" male and female connectors 110, 140, respectively, will mate together to provide multiple independent electrical connections therethrough, "alternate" male and female connectors 10, 40, respectively, will mate together to provide multiple independent electrical connections therethrough, alternate female connector 40 will accept the connectors 110, 10, respectively, but the original female connector 140 will only accept the original connector 110 and not the alternate connector 10, due to the interference with the small guide 15 of the connector 10 and the guide 144 of the female connector 140.

Generally described, the connector 10 assembled by machining, assembling, and plating its body, including the locking sleeve thereon. A preassembled contact block, composed of the insulator, contacts, and guides, is pressed inside the body. It should be understood, however, that the process in which the plug shown herein are manufactured can be such as known in the prior art, and is not the central feature of the claimed invention. Instead the orientation and positioning of the guides is the central part of the present invention, which provides the interaction such as shown in FIG. 6.

The Female Connector

FIG. 3 is a side elevational view of a "female"-type electrical connector assembly 40 or "receptacle", which shows a body 42, a molded insulator 47, sleeve-type solid electrical contacts 46 such as known in the art, and first and second guides 44, 45, respectively. The assembly 40 is shown in FIG. 3 alongside a threaded nut 50 having internal threads 59 which engage external threads 49 on the body 42 of the connector assembly 40.

As FIG. 3 is viewed, the right ends of the tubular-type electrical contacts engage and provide the detachable electrical connection points; the ends on the left accept solder or other types of more permanent electrical connections.

Generally described, the receptacle is assembled by machining, assembling, and plating the body. A preassembled contact block is placed inside the body from the rear. A retaining ring is then placed over the contact block, and then swaged around the retaining ring. The mounting nut 50 is then installed. It should be understood, however, that the process in which the receptacle shown herein are manufactured can be such as known in the prior art, and is not the central feature of the claimed invention, Instead the orientation and positioning of the guides is the central part of the present invention, which provides the interaction such as shown in FIG. 6.

It should be understood that the configuration shown in FIG. 3 is a "chassis" receptacle"-type of receptacle configuration. However, it should also be understood that a "cable receptacle" configuration could also be used without departing from the spirit and scope of the present invention, in which the receptacle is attached to the end of a cord.

Interconnection of Connectors

Figure 4A:
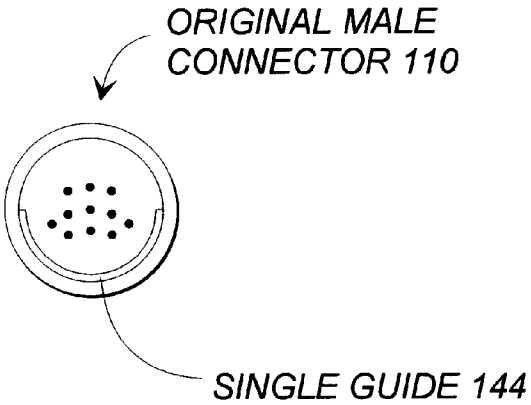
FIGS. 4A and 4B show end elevational views of "original" (a.k.a "existing" or "old") male and female connectors 110, 140, respectively, which will mate together to provide multiple independent electrical connections therethrough. Their respective guides 114, 144, do not interfere but in fact slide adjacent to each other providing the guiding function described later.
Figure 4B:
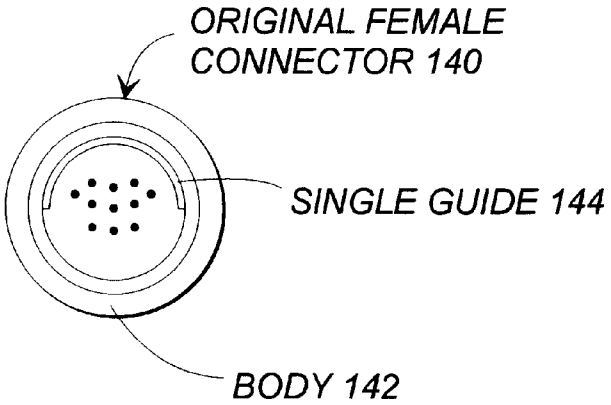

FIGS. 4A and 4B show end elevational views of "old" (a.k.a "existing" or "original") male and female connectors 110, 140, respectively, which will mate together to provide multiple independent electrical connections therethrough. Their respective guides 114, 144, do not interfere but in fact slide adjacent to each other providing a guide function.

Figure 5A:
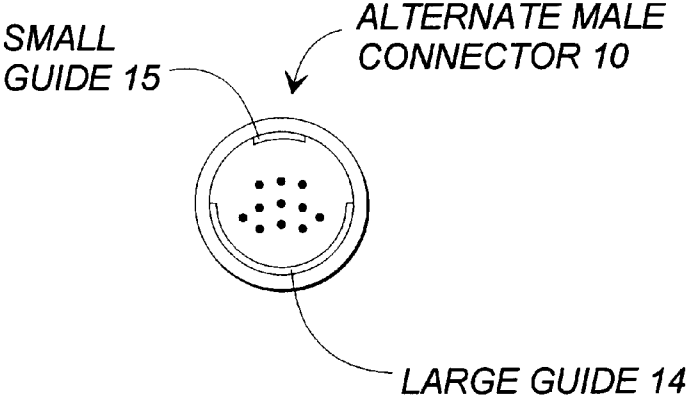
FIGS. 5A and 5B show end elevational views of "new" (a.k.a "alternate" or "upgraded") male and female connectors 10, 40, respectively, which will mate together to provide multiple independent electrical connections therethrough. Their respective guides 14, 15 and 44, 45, do not interfere but in fact slide adjacent to each other providing the guiding function described later.
Figure 5B:
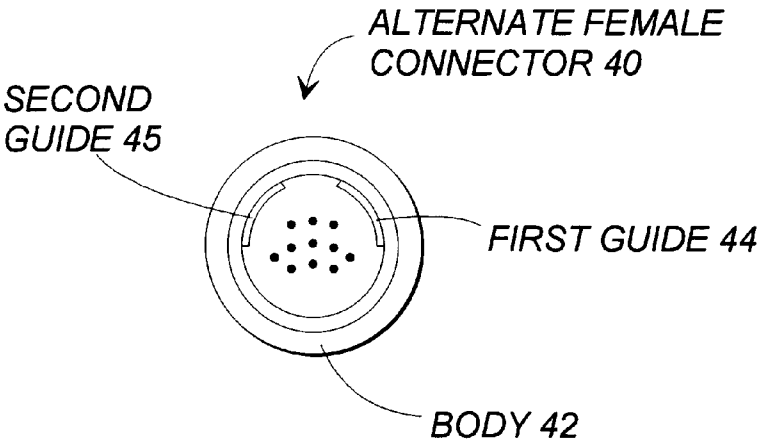
Figure 7:
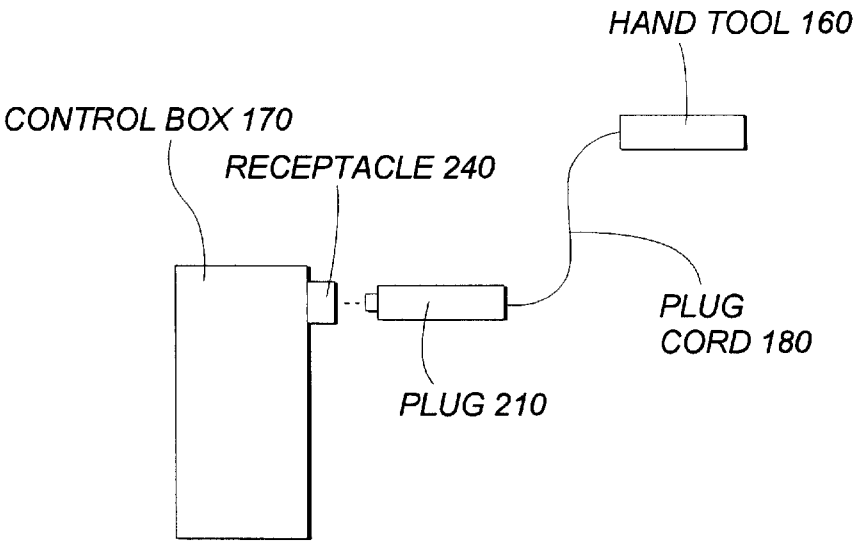
FIG. 7 is a simplified illustration showing the interaction of a typical control box 170 and a hand tool 160 via an electrical cord 180 leading from the hand tool 160 to a plug 210 which engages a receptacle 240 leading to circuitry within the control box. This configuration can apply to either of the original or alternate systems discussed elsewhere, and it should be understood that the use of a hand tool and/or control box is only by way of example, as other configurations are certainly contemplated.

FIGS. 5A and 5B show end elevational views of "new" (a.k.a "alternate" or "upgraded") male and female connectors 10, 40, respectively, which will mate together to provide multiple independent electrical connections therethrough. Their respective guides 14, 15 and 44, 45, do not interfere but in fact slide adjacent to each other providing a guide function.

FIG. 6 shows the essence of the invention, in which "existing" male and female connectors 110, 140, respectively, will mate together to provide multiple independent electrical connections therethrough, "alternate" male and female connectors 10, 40, respectively, will mate together to provide multiple independent electrical connections therethrough, female connector 40 will accept both the connectors 110, 10, respectively, but the "old" female connector 140 will only accept the connector 110 and not the connector 10, due to the interference with the small guide 15 of the connector 10 and the guide 144 of the female connector 140.

Use Within An Overall System

Reference is now made to FIG. 8, which is a simplified illustration showing the interaction of a typical control box 170 and a hand tool 160 via an electrical cord leading from the hand tool 160 to a plug 210 which engages a receptacle 240 leading to circuitry within the control box. This configuration can apply to either of the original or alternate systems discussed elsewhere, and it should be understood that the use of a hand tool and/or control box is only by way of example, as other configurations are certainly contemplated.

Materials

The materials used may be such as those known in the art.

Alternate Configurations

It should be understood that other connectors falling within the spirit and scope of the present invention do not include "ribs" about an outer, movable sleeve. Such connectors can also include single-piece bodies which do not provide the locking feature provided by the outer, movable sleeve.

The pins and sleeves are likewise readily reversible within a particular pin or receptacle combination.

As noted, above, the female "receptacle" is the part that can go in a hole in a cabinet, as in a chassis receptacle. The receptacle mounts into sheet metal such as shown in FIG. 3, although other versions are possible. Another version contemplates the use of receptacle which mount on the end of a cable, much like an extension cord, as in a "cable receptacle".

In one embodiment, the female sleeve-type contact tips are typically about a millimeter below the surface of the installing material. The male pins should be about a millimeter below the guide surface. However, other configurations are contemplated without departing from the spirit and scope of the present invention.

CONCLUSION

While this invention has been described in specific detail with reference to the disclosed embodiments, it will be understood that many variations and modifications may be effected within the spirit and scope of the invention as described in the appended claims.

What is claimed is:

1. An electrical connector group for use within an electrical system composed of a first original electrical component, a second original electrical component, a first alternate electrical component, and a second alternate electrical component, said electrical connector group comprising:

a first original electrical connector electrically connected to said first original electrical component;

a second original electrical connector electrically connected to said second original electrical component;

a first alternate electrical connector electrically connected to said first alternate electrical component; and a second alternate electrical connector electrically connected to said second alternate electrical component;

said electrical connector group configured to allow for said first original electrical connector to electrically connect with either said second original electrical connector or said second alternate electrical connector, while restricting connection between said first alternate electrical connector to connection only with said second alternate electrical connector, thus preventing electrical connection between said first alternate electrical connector and said second original electrical connector, said configuration provided by 1) one of said first and second alternate electrical connectors being a "female"-type receptacle defining a substantially cylindrical bore female cavity having an inner diameter defined by an interior cylindrical wall surface, said one of said first and second alternate electrical connectors also including a first pair of spaced-apart arc-shaped guide segments positioned adjacent two portions of said interior cylindrical wall surface;

2) the other of said first and second alternate electrical connectors being a "male"-type member including a substantially cylindrical protruding core portion having an outer diameter defined by an exterior cylindrical wall surface, said other of said first and second alternate electrical connectors also including a second pair of spaced-apart arc-shaped guide segments positioned adjacent two portions of said exterior cylindrical wall surfaces; and 3) said first and second plurality of arc-shaped guide segments all having a similar nominal thickness being substantially the difference between the outer diameter of said female-type receptacle and the inner diameter of said male-type member, such that when said male-type member is inserted into said female member, said first and second plurality of spaced-apart arc-shaped guides fit within an elongate ring-shaped space defined between said interior cylindrical wall surface of said substantially cylindrical bore female cavity and said exterior cylindrical wall surface of said male member in an alternating fashion, in that each one of said first plurality of said arc-shaped guide segments is located between two of said plurality of said second plurality of said arc-shaped guide segments, and one of said second plurality of said arc-shaped guide segments is located between two of said plurality of said first plurality of said arc-shaped guide segments.

2. The electrical connector group as claimed in claim 1, wherein said first original electrical connector is electrically connected to a hand tool.

3. The electrical connector group as claimed in claim 1, wherein said second alternate electrical connector is electrically connected to a control box.

4. The electrical connector group as claimed in claim 1, wherein said first original electrical connector is a plug.

5. The electrical connector group as claimed in claim 1, wherein said first original electrical connector is a receptacle.

6. The electrical connector group as claimed in claim 1, wherein said second original electrical connector is a plug.

7. The electrical connector group as claimed in claim 1, wherein said second original electrical connector is a receptacle.

8. An electrical system configuration, said configuration comprising:

a first original electrical component;

a second original electrical component;

a first alternate electrical component; and a second alternate electrical component;

said electrical connection system configured to allow for said first original electrical component to electrically connect with either said second original electrical component or said second alternate electrical component, while restricting connection between said first alternate electrical component to connection only with said second alternate electrical component, thus preventing electrical connection between said first alternate electrical component and said second original electrical component, said configuration provided by 1) one of said first and second alternate electrical components being a "female"-type receptacle defining a substantially cylindrical bore female cavity having an inner diameter defined by an interior cylindrical wall surface, said one of said first and second alternate electrical components also including a first pair of spaced-apart arc-shaped guide segments positioned adjacent two portions of said interior cylindrical wall surface;

2) the other of said first and second alternate electrical components being a "male"-type member including a substantially cylindrical protruding core portion having an outer diameter defined by an exterior cylindrical wall surface, said other of said first and second alternate electrical components also including a second pair of spaced-apart arc-shaped guide segments positioned adjacent two portions of said exterior cylindrical wall surfaces; and 3) said first and second plurality of arc-shaped guide segments all having a similar nominal thickness being substantially the difference between the outer diameter of said female-type receptacle and the inner diameter of said male-type member, such that when said male-type member is inserted into said female member, said first and second plurality of spaced-apart arc-shaped guides fit within an elongate ring-shaped space defined between said interior cylindrical wall surface of said substantially cylindrical bore female cavity and said exterior cylindrical wall surface of said male member in an alternating fashion, in that each one of said first plurality of said arc-shaped guide segments is located between two of said plurality of said second plurality of said arc-shaped guide segments, and one of said second plurality of said arc-shaped guide segments is located between two of said plurality of said first plurality of said arc-shaped guide segments.

9. An electrical system configuration for use with a first original electrical component and a second original electrical component, said electrical system configuration comprising:

a first alternate electrical component; and a second alternate electrical component;

said electrical connection system configured to allow for said first original electrical component to electrically connect with either said second original electrical component or said second alternate electrical component, while restricting connection between said first alternate electrical component to connection only with said second alternate electrical component, thus preventing electrical connection between said first alternate electrical component and said second original electrical component, said configuration provided by 1) one of said first and second alternate electrical components being a "female"-type receptacle defining a substantially cylindrical bore female cavity having an inner diameter defined by an interior cylindrical wall surface, said one of said first and second alternate electrical components also including a first pair of spaced-apart arc-shaped guide segments positioned adjacent two portions of said interior cylindrical wall surface;

2) the other of said first and second alternate electrical components being a "male"-type member including a substantially cylindrical protruding core portion having an outer diameter defined by an exterior cylindrical wall surface, said other of said first and second alternate electrical components also including a second pair of spaced-apart arc-shaped guide segments positioned adjacent two portions of said exterior cylindrical wall surfaces; and 3) said first and second plurality of arc-shaped guide segments all having a similar nominal thickness being substantially the difference between the outer diameter of said female-type receptacle and the inner diameter of said male-type member, such that when said male-type member is inserted into said female member, said first and second plurality of spaced-apart arc-shaped guides fit within an elongate ring-shaped space defined between said interior cylindrical wall surface of said substantially cylindrical bore female cavity and said exterior cylindrical wall surface of said male member in an alternating fashion, in that each one of said first plurality of said arc-shaped guide segments is located between two of said plurality of said second plurality of said arc-shaped guide segments, and one of said second plurality of said arc-shaped guide segments is located between two of said plurality of said first plurality of said arc-shaped guide segments.

10. The electrical system configuration of claim 9, wherein one of said guides within said plurality of said arc-shaped guide segments extends substantially 180 around said elongate ring-shaped space.

* * * * *

UNITED STATES PATENT AND TRADEMARK OFFICE

CERTIFICATE OF CORRECTION

PATENT NO. : 5,899,766

DATED : May 4, 1999

INVENTOR(S) : Stephen V. Defeo

It is certified that error appears in the above-identified patent and that said Letters Patent is hereby corrected as shown below:

On the title page, item [75],
Inventor's Name: Steven V. DeFeo (not Stephen V. DeFeo)

Signed and Sealed this

Twenty-eighth Day of March, 2000

*Attest:*

Q. TODD DICKINSON

*Attesting Officer*

*Commissioner of Patents and Trademarks*